US009883316B2

(12) United States Patent
Jo et al.

(10) Patent No.: US 9,883,316 B2
(45) Date of Patent: Jan. 30, 2018

(54) METHOD OF GENERATING MULTI-CHANNEL AUDIO SIGNAL AND APPARATUS FOR CARRYING OUT SAME

(71) Applicant: SAMSUNG ELECTRONICS CO., LTD., Suwon-si, Gyeonggi-do (KR)

(72) Inventors: Seok-hwan Jo, Suwon-si (KR); Do-Hyung Kim, Hwaseong-si (KR); Kang-eun Lee, Hwaseong-si (KR); Si-hwa Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 14/515,622

(22) Filed: Oct. 16, 2014

(65) Prior Publication Data

US 2015/0117650 A1 Apr. 30, 2015

(30) Foreign Application Priority Data

Oct. 24, 2013 (KR) ..... 10-2013-0127296

(51) Int. Cl.
*H04S 7/00* (2006.01)
*H04S 5/00* (2006.01)

(52) U.S. Cl.
CPC ..... *H04S 7/302* (2013.01); *H04S 5/00* (2013.01); *H04S 7/30* (2013.01); *H04S 2400/01* (2013.01); *H04S 2400/11* (2013.01)

(58) Field of Classification Search
CPC ... H04S 7/302; H04S 5/00; H04S 7/30; H04S 2400/01; H04S 2400/11
USPC ..... 381/17, 310; 700/94
See application file for complete search history.

(56) References Cited

U.S. PATENT DOCUMENTS

| | | | |
|---|---|---|---|
| 8,295,516 | B2 | 10/2012 | Kondo et al. |
| 9,148,740 | B2 | 9/2015 | Kim |
| 2005/0249373 | A1 | 11/2005 | Yamashita |
| 2006/0045295 | A1 | 3/2006 | Kim |
| 2010/0111336 | A1 | 5/2010 | Jeong et al. |
| 2010/0119092 | A1 | 5/2010 | Kim et al. |

(Continued)

FOREIGN PATENT DOCUMENTS

| | | | |
|---|---|---|---|
| CN | 1691699 | A | 11/2005 |
| CN | 101175337 | A | 5/2008 |
| CN | 101742378 | A | 6/2010 |

(Continued)

OTHER PUBLICATIONS

International Search Report and Written Opinion of the International Searching Authority dated Jan. 20, 2015 in corresponding PCT Application PCT/KR2014/009997.

(Continued)

*Primary Examiner* — Xu Mei
*Assistant Examiner* — Douglas Suthers
(74) *Attorney, Agent, or Firm* — Staas & Halsey LLP

(57) ABSTRACT

A method of generating a multi-channel audio signal includes: representing locations of a plurality of speakers as a plurality of polygons whose vertices are located at locations of corresponding speakers; acquiring a location of an object sound; calculating distances between the plurality of polygons and the location of the object sound; selecting one of the plurality of polygons on the basis of the calculated distances; and generating a multi-channel audio signal that corresponds to speakers corresponding to the selected polygon by mapping the object sound to the speakers corresponding to the selected polygon.

19 Claims, 12 Drawing Sheets

(56) References Cited

U.S. PATENT DOCUMENTS

2012/0314875 A1 12/2012 Lee et al.

FOREIGN PATENT DOCUMENTS

| | | | |
|---|---|---|---|
| CN | 102972047 | A | 3/2013 |
| EP | 2187658 | A2 | 5/2010 |
| WO | 2011-139090 | A2 | 11/2011 |
| WO | 2013-006330 | A2 | 1/2013 |

OTHER PUBLICATIONS

2nd Chinese Office Action issued Jul. 25, 2017 in related Chinese Patent Application No. 201480065512.4 (6 pages) (6 pages English Translation).

Extended European Search Report dated May 17, 2017 in related European Patent Application No. 14855194.8 (7 pages).

Pulkii V: "*Virtual Sound Source Positioning Using Vector Base Amplitude Panning*". Journal of the Audio Engineering Society, Audio Engineering Society, New York, NY, US, vol. 45, No. 6, Jun. 1, 1996 (Jun 6, 1996), pp. 456-466, XP000695381, ISSN: 1549-4950 (11 pages).

First Chinese Office Action dated Jan. 3, 2017 in related Chinese Patent Application No. 201480065512.4 (7 pages) (6 pages English Translation).

FIG. 7

| No. | Label | Az ° | Az. Tol ° | El ° | El ToL° |
|---|---|---|---|---|---|
| 1 | FC | 0 | ±2 | 0 | ±2 |
| 2 | FLc | 30 | ±2 | 0 | ±2 |
| 3 | FRc | −30 | ±2 | 0 | ±2 |
| 4 | FL | 60 | ±2 | 0 | ±2 |
| 5 | FR | −60 | ±2 | 0 | ±2 |
| 6 | SiL | 90 | ±5 | 0 | ±2 |
| 7 | SiR | −90 | ±5 | 0 | ±2 |
| 8 | BL | 135 | ±5 | 0 | ±2 |
| 9 | BR | −135 | ±5 | 0 | ±2 |
| 10 | BC | 180 | ±5 | 0 | ±2 |
| 11 | TpFC | 0 | ±2 | 35 | ±10 |
| 12 | TpFL | 45 | ±5 | 35 | ±10 |
| 13 | TpFR | −45 | ±5 | 35 | ±10 |
| 14 | TpSiL | 90 | ±5 | 35 | ±10 |
| 15 | TpSiR | −90 | ±5 | 35 | ±10 |
| 16 | TpBL | 135 | ±5 | 35 | ±10 |
| 17 | TpBR | −135 | ±5 | 35 | ±10 |
| 18 | TpBC | 180 | ±5 | 35 | ±10 |
| 19 | TpC | 0 | ±2 | 90 | ±10 |
| 20 | BtFC | 0 | ±2 | −15 | +5−25 |
| 21 | BtFL | 45 | ±5 | −15 | +5−25 |
| 22 | BtFR | −45 | ±5 | −15 | +5−25 |
| 23 | LFE1 | 45 | ±15 | −15 | ±15 |
| 24 | LFE2 | −45 | ±15 | −15 | ±15 |

FIG. 8

| Triangle # | Vertex 1 | Vertex 2 | Vertex 3 |
|---|---|---|---|
| 1 | TpFL | TpFC | TpC |
| 2 | TpFC | TpFR | TpC |
| 3 | TpSiL | BL | SiL |
| 4 | BL | TpSiL | TpBL |
| 5 | TpSiL | TpFL | TpC |
| 6 | TpBL | TpSiL | TpC |
| 7 | BR | TpSiR | SiR |
| 8 | TpSiR | BR | TpBR |
| 9 | TpFR | TpSiR | TpC |
| 10 | TpSiR | TpBR | TpC |
| 11 | BL | TpBC | BC |
| 12 | TpBC | BL | TpBL |
| 13 | TpBC | BR | BC |
| 14 | BR | TpBC | TpBR |
| 15 | TpBC | TpBL | TpC |
| 16 | TpBR | TpBC | TpC |
| 17 | TpSiR | FR | SiR |
| 18 | FR | TpSiR | TpFR |
| 19 | FL | TpSiL | SiL |
| 20 | TpSiL | FL | TpFR |
| 21 | BtFL | FL | SiL |
| 22 | FR | BtFL | SiR |
| 23 | BtFL | FLc | FL |
| 24 | TpFC | FLc | FC |
| 25 | FLc | BtFC | FC |
| 26 | FLc | BtFL | BtFC |
| 27 | FLc | TpFC | TpFL |
| 28 | FL | FLc | TpFL |
| 29 | FRc | BtFR | FR |
| 30 | FRc | TpFC | FC |
| 31 | BtFC | FRc | FC |
| 32 | BtFR | FRc | BtFC |
| 33 | TpFC | FRc | TpFR |
| 34 | FRc | FR | TpFR |

METHOD OF GENERATING MULTI-CHANNEL AUDIO SIGNAL AND APPARATUS FOR CARRYING OUT SAME

CROSS-REFERENCE TO RELATED APPLICATIONS

This application claims the benefit of Korean Patent Application No. 10-2013-0127296, filed on Oct. 24, 2013, in the Korean Intellectual Property Office, the disclosure of which is incorporated herein in its entirety by reference.

BACKGROUND

1. Field

One or more embodiments of the present disclosure relate to a method and apparatus for generating a multi-channel audio signal corresponding to a location of an object sound.

2. Description of the Related Art

Recently, multi-channel speaker systems have been widely used for a rich acoustic effect. A multi-channel speaker system may reproduce a stereoscopic sound by controlling a plurality of speakers for respective channels.

For example, the system may control the plurality of speakers so that only some of the plurality of speakers output a sound corresponding to an object or that some of the plurality of speakers more loudly output the sound corresponding to the object than the other speakers, in order to output the sound as if the sound were actually made at a location of the object. In detail, an audience may feel as if a car were actually moving before their eyes by the system controlling a speaker corresponding to a location of the car on a screen to output an engine sound of the car when a car appears in a movie and controlling speakers corresponding to a moving pathway to output the engine sound of the car when the car moves.

When a three-dimensional (3D) stereoscopic sound effect is produced, the efficiency may be raised and the effect of a stereoscopic sound may be maximized by reproducing an object sound only with some speakers around a location of an object. Therefore, it is recommended that a certain number of speakers closest to a location of an object in a virtual space are selected by using location information of the object. For example, when a vector base amplitude panning (VBAP) technique of reproducing a 3D stereoscopic object sound by using three speakers is used, three speakers corresponding to each object should be selected from among a plurality of speakers.

However, in general, several objects to be represented frequently exist at the same time, and in addition, each of the objects may move, and thus, it is recommended that a time taken to select speakers corresponding to each object is minimized.

SUMMARY

One or more embodiments of the present disclosure include a method and apparatus for generating a multi-channel audio signal to reproduce a location-based three-dimensional (3D) stereoscopic sound corresponding to an object sound, in a multi-channel speaker system.

One or more embodiments of the present disclosure include a method of quickly selecting a plurality of speakers to be used for reproducing an object sound from among a plurality of speakers included in a system.

Additional aspects will be set forth in part in the description which follows and, in part, will be apparent from the description, or may be learned by practice of the presented embodiments.

According to one or more embodiments of the present disclosure, a method of generating a multi-channel audio signal includes: representing locations of a plurality of speakers as a plurality of polygons whose vertices are located at locations of corresponding speakers; acquiring a location of an object sound; calculating distances between the plurality of polygons and the location of the object sound; selecting one of the plurality of polygons on the basis of the calculated distances; and generating a multi-channel audio signal that corresponds to speakers corresponding to the selected polygon by mapping the object sound to the speakers corresponding to the selected polygon.

The calculating of the distances may include: selecting an arbitrary point on the plurality of polygons as a reference point with respect to each of the plurality of polygons; and calculating distances between the selected reference points and the location of the object sound.

The method may further include: detecting a changed location of the object sound when the location of the object sound is changed in a subsequent frame after generating a multi-channel audio signal with respect to any one frame; calculating distances between some of the plurality of polygons and the changed location of the object sound; selecting one of the some of the plurality of polygons on the basis of the calculated distances; and generating a multi-channel audio signal that corresponds to speakers corresponding to the selected polygon by mapping the object sound to the speakers corresponding to the selected polygon.

The calculating of the distances between the some of the plurality of polygons and the changed location of the object sound may include: selecting polygons existing within a certain range from the polygon selected with respect to the any one frame from among the plurality of polygons; and calculating distances from the changed location of the object sound only with respect to the selected polygons existing within the certain range.

According to one or more embodiments of the present disclosure, an apparatus for generating a multi-channel audio signal includes: a location information acquisition unit for acquiring a location of an object sound; an object sound reception unit for receiving the object sound; a speaker selection unit for calculating distances between the location of the object sound and a plurality of polygons whose vertices are located at locations of corresponding speakers, selecting one of the plurality of polygons on the basis of the calculated distances, and selecting speakers corresponding to the selected polygon; an object sound reconfiguration unit for reconfiguring the object sound with respect to the selected speakers; and a channel control unit for outputting a multi-channel audio signal so that the selected speakers output the reconfigured object sound.

The speaker selection unit may include: a mesh structure representation unit for representing locations of a plurality of speakers as the plurality of polygons whose vertices are located at locations of corresponding speakers; a distance calculation unit for calculating distances between the location of the object sound and the plurality of polygons; and a distance comparison unit for selecting one of the plurality of polygons on the basis of the calculated distances.

The distance calculation unit may select an arbitrary point on the plurality of polygons as a reference point with respect to each of the plurality of polygons and calculate distances between the selected reference points and the location of the object sound.

When the location of the object sound is changed in a subsequent frame after generating a multi-channel audio signal with respect to any one frame, the distance calculation unit may detect the changed location of the object sound and calculate distances between some of the plurality of polygons and the changed location of the object sound.

The distance calculation unit may select polygons existing within a certain range from the polygon selected with respect to the any one frame from among the plurality of polygons and calculate distances from the changed location of the object sound only with respect to the selected polygons existing within the certain range.

According to one or more embodiments of the present disclosure, a method of generating a multi-channel audio signal by representing a plurality of speakers included in a multi-channel speaker system as a mesh structure including a plurality of polygons whose vertices are located at locations of each of the plurality of speakers is discussed. The method includes acquiring a location of an object sound in a current frame using location information of the object sound from a previous frame, selecting polygons existing within a certain distance of a polygon selected with the location information of the object sound from the previous frame, calculating, by way of a hardware-based processor, a distance between each of the selected polygons existing within the certain distance and the location of the object sound in the current frame, selecting one polygon, from among the polygons existing within the certain distance, based on the calculated distances, and mapping the sound of the object to the speakers corresponding to the selected one polygon.

According to one or more embodiments of the present disclosure, a method of generating a multi-channel audio signal includes representing a plurality of speakers included in a multi-channel speaker system as a mesh structure including a plurality of polygons whose vertices are located at locations of each of the plurality of speakers, acquiring a location of a sound of an object, calculating, by way of a hardware-based processor, a distance between each of the plurality of polygons and the acquired location of the sound of the object, selecting a polygon of the plurality of polygons based on the calculated distances, mapping the sound of the object to the speakers corresponding to the selected polygon.

BRIEF DESCRIPTION OF THE DRAWINGS

These and/or other aspects will become apparent and more readily appreciated from the following description of the embodiments, taken in conjunction with the accompanying drawings in which:

FIG. 7 is a table showing locations of speakers included in the 22.2-channel speaker system proposed by NHK and handled in the MPEG H 3D audio standard;

FIG. 8 is a table showing a triangular mesh structure whose vertices are located at locations of corresponding speakers, which represents the 22.2-channel speaker system proposed by NHK and handled in the MPEG H 3D audio standard;

DETAILED DESCRIPTION

Figure 1:
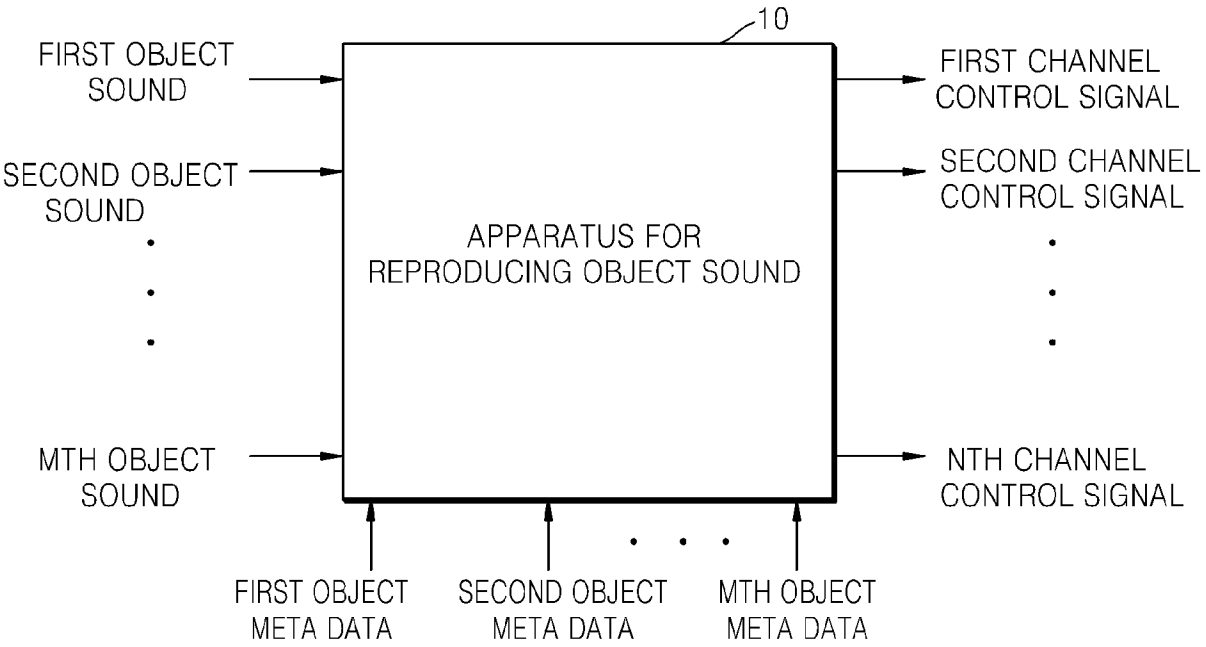
FIG. 1 is a block diagram of a typical apparatus for reproducing an object sound.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. To more clearly describe the features of the embodiments, a detailed description of matters well-known to those of ordinary skill in the art to which the embodiments below belong will be omitted. As used herein, the term "and/or" includes any and all combinations of one or more of the associated listed items. Expressions such as "at least one of," when preceding a list of elements, modify the entire list of elements and do not modify the individual elements of the list.

Before describing the embodiments of the present disclosure, a technique of reproducing a stereoscopic sound corresponding to a location of an object sound, which is the basis of the present disclosure, is described.

FIG. 1 is a block diagram of a conventional apparatus 10 for reproducing an object sound. Referring to FIG. 1, the apparatus 10 receives a sound and metadata with respect to each of M objects and outputs control signals for N channels, wherein first to Mth object sounds and first to Mth object metadata correspond to first to Mth objects, respectively, and each object metadata includes location information of each corresponding object sound. That is, in an embodiment, the apparatus 10 receives a sound emanating from or associated with a particular object and metadata with respect the particular object.

The apparatus 10 controls a multi-channel speaker system so as to exhibit a stereoscopic sound effect by using sound and location information for each of the M objects as if each object sound were reproduced at a respective location of each object.

In order to reproduce a sound of any one object, the apparatus 10 detects a location of a corresponding object sound from location information of the corresponding object sound and selects speakers to output the object sound according to the detected location. In addition, the apparatus 10 outputs control signals corresponding to the selected speakers so that the selected speakers output the object sound. In this case, first to Nth channel control signals are signals for controlling first- to Nth-channel speakers, respectively.

For example, when speakers corresponding to a location of a third object are the fourth-to-sixth channel speakers as a result of analyzing location information of the third object, the apparatus 10 outputs fourth-to-sixth channel control signals so that the fourth-to-sixth channel speakers output a sound of the third object. That is, in an embodiment, when fourth-to-sixth channel speakers provide the best approximation of the location of the sound of the third object as a result of analyzing location information of the third object, the apparatus 10 outputs fourth-to-sixth channel control signals so that the fourth-to-sixth channel speakers output a sound of the third object.

When a sound of a certain object is reproduced, speakers selected on the basis of a location of an object sound may output the object sound with the same volume. However, the location accuracy of the object sound may be higher by adjusting a volume to be output from each speaker according to the location of the object sound. For example, a location of an object sound may be more accurately represented by outputting the object sound at a higher volume from a speaker that is closer to the location of the object sound, from among speakers selected to output the object sound.

A representative method of reproducing a three-dimensional (3D) stereoscopic sound based on a location of an object sound using a plurality of speakers is a vector base amplitude panning (VBAP) method. According to the VBAP method, an object sound is reproduced using three speakers, wherein a gain corresponding to each speaker is calculated according to a location of the object sound and multiplied by a volume of the object sound to be output from a corresponding speaker.

Figure 2:
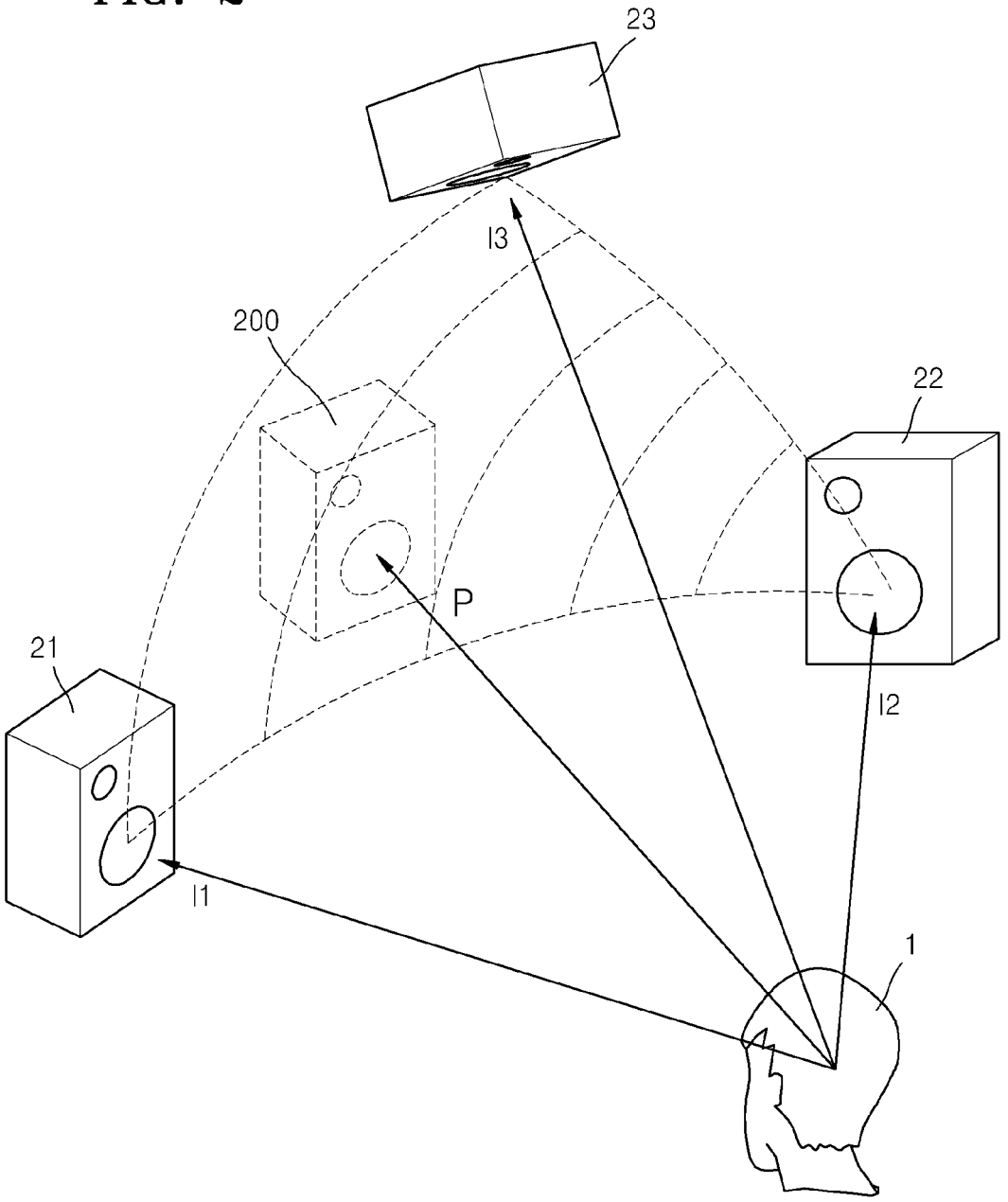
FIG. 2 illustrates a vector base amplitude panning (VBAP) method.

FIG. 2 illustrates the VBAP method. Referring to FIG. 2, three speakers 21, 22, and 23 are arranged around a user 1, and locations of the three speakers 21, 22, and 23 are represented by location vectors l1, l2, and l3, respectively. A location vector p, indicating a location of an object sound, is expressed by Equation 1, wherein p1, p2, and p3 denote coordinates of an object on an x axis, a y axis, and a z axis, respectively.

$$p=[p_1,p_2,p_3] \quad \text{Equation 1:}$$

$$l_1=[l_{11},l_{12},l_{13}] \quad \text{Equation 2:}$$

$$l_2=[l_{21},l_{22},l_{23}] \quad \text{Equation 3:}$$

$$l_3=[l_{31},l_{32},l_{33}] \quad \text{Equation 4:}$$

Assuming that gains of the speakers 21, 22 and 23 corresponding to the location vectors l1, l2, and l3 are g1, g2, and g3, respectively, Equation 5 below is satisfied.

$$p=g_1l_1+g_2l_2+g_3l_3=gL \quad \text{Equation 5:}$$

Therefore, by using Equation 6, a gain corresponding to each of the speakers 21, 22, and 23 may be obtained from the location vector p of the object sound and the location vectors l1, l2, and l3 of the speakers 21, 22, and 23.

$$g=[g_1,g_2,g_3]=pL^{-1}=[p_1,p_2,p_3]\begin{bmatrix} l_{11} & l_{12} & l_{13} \\ l_{21} & l_{22} & l_{23} \\ l_{31} & l_{32} & l_{33} \end{bmatrix}^{-1} \quad \text{Equation 6}$$

After respectively calculating the gains g1, g2, and g3 for the speakers 21, 22, and 23, an effect as if a sound were output from a virtual speaker 200 existing at the location of the object sound may be obtained by multiplying the gain g1, g2, or g3 by a sound output from each of the speakers 21, 22, and 23. That is, the gain g1 is multiplied by a sound output from the speaker 21 corresponding to the location vector l1, and the gains g2 and g3 are respectively multiplied by sounds output from the other speakers 22 and 23.

As described above, to reproduce an object sound by using the VBAP method, it is recommended that three speakers corresponding to a location of the object sound are first selected. However, for a general audio signal, several objects to be represented at the same time frequently exist, and in addition, each of the objects may move, and thus, it is recommended that a time taken to select speakers corresponding to each object be minimized.

Therefore, in the embodiments of the present disclosure to be described below, a method capable of quickly selecting speakers corresponding to a location of each object sound is proposed.

Figure 3:
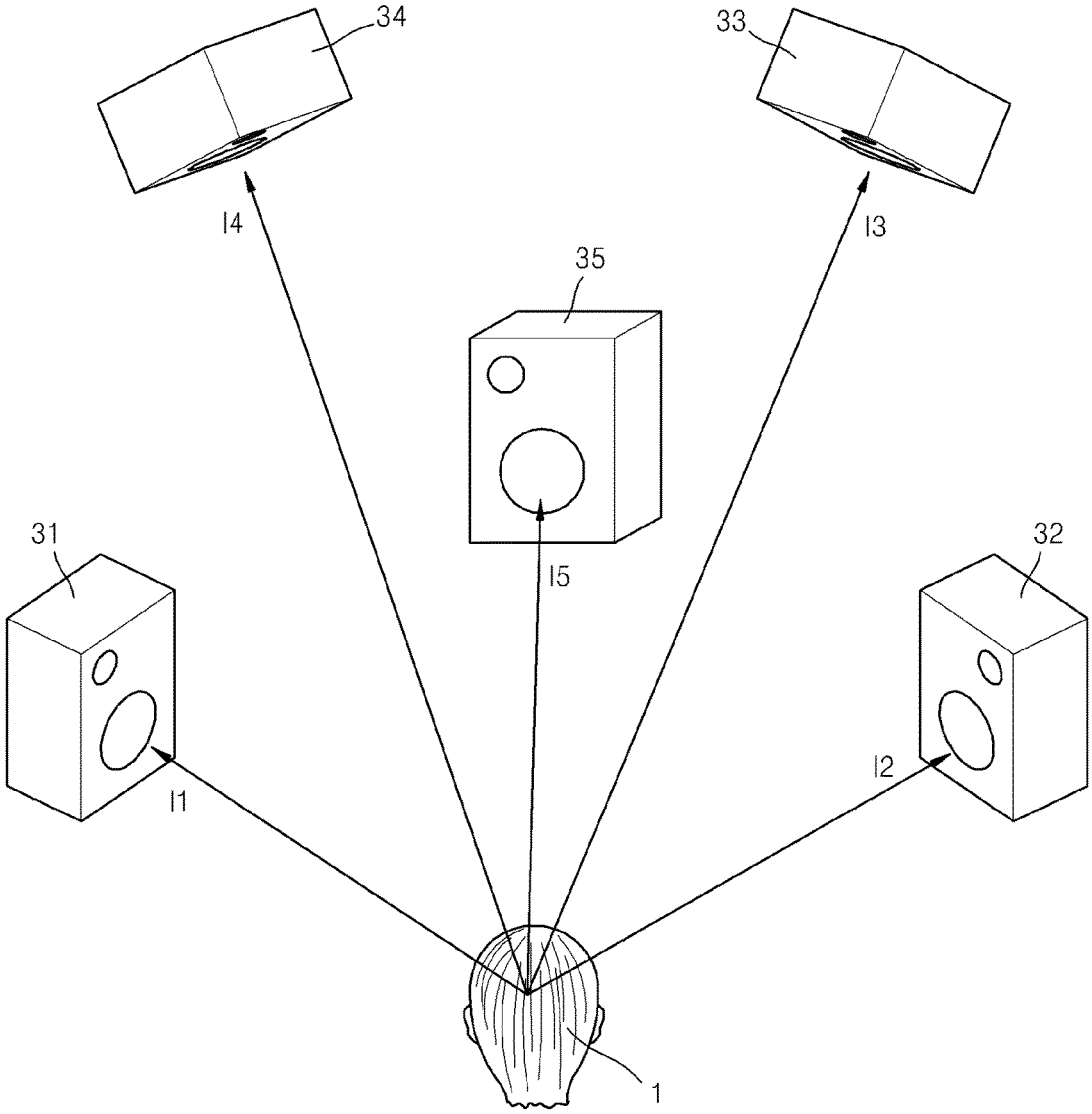
FIG. 3 illustrates a 5-channel speaker system according to an embodiment of the present disclosure.

FIG. 3 illustrates a 5-channel speaker system according to an embodiment of the present disclosure. Referring to FIG. 3, five speakers are arranged around a listener or user 1. In detail, a first speaker 31 corresponding to a location vector l1, a second speaker 32 corresponding to a location vector l2, a third speaker 33 corresponding to a location vector l3, a fourth speaker 34 corresponding to a location vector l4, and a fifth speaker 35 corresponding to a location vector l5 are arranged.

To reproduce an object sound by applying the VBAP method described above, three speakers are selected according to a location of the object sound. In this case, to represent the location of the object sound realistically, it is recommended that speakers that are closer to a location of the object than the other speakers be selected. A detailed method of selecting three speakers corresponding to the location of the object sound will now be described with reference to FIGS. 4 and 5.

Figure 4:
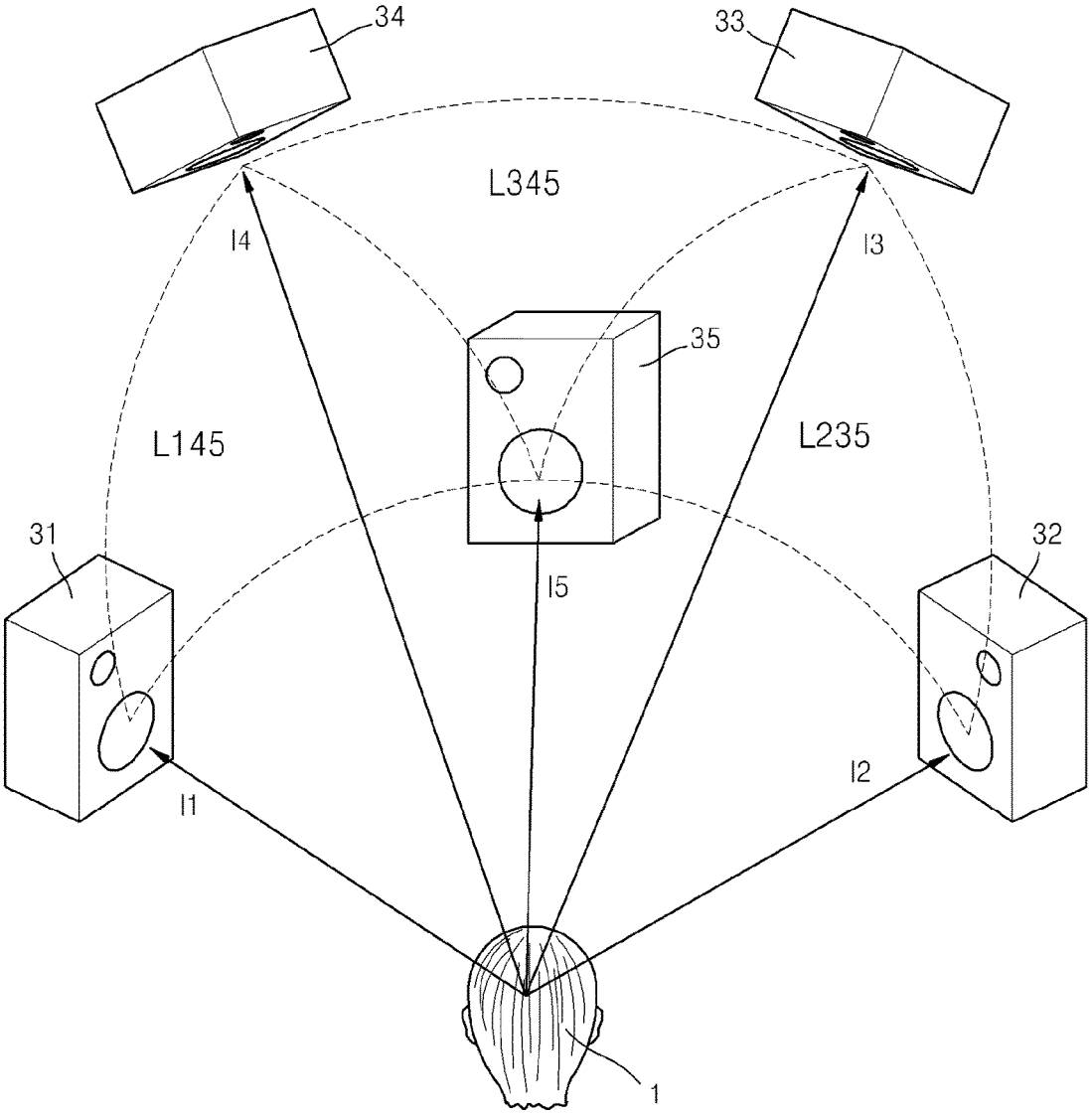
FIG. 4 illustrates a triangular mesh structure representing the 5-channel speaker system according to an embodiment of the present disclosure.

FIG. 4 illustrates a triangular mesh structure representing the 5-channel speaker system according to an embodiment of the present disclosure. Referring to FIG. 4, the 5-channel speaker system may be represented by a mesh structure including three triangles. In detail, the mesh structure may include a first triangle L145 whose vertices are located at locations of the first speaker 31, the fourth speaker 34, and the fifth speaker 35, a second triangle L345 whose vertices are located at locations of the fourth speaker 34, the fifth speaker 35, and the third speaker 33, and a third triangle L235 whose vertices are located at the locations of the second speaker 32, the third speaker 33, and the fifth speaker 35.

In the current embodiment, since three speakers are selected for application of the VBAP method, a mesh structure including triangles is used. However, when four or more speakers are used to reproduce a sound of a single object, a mesh structure including polygons having four or more sides may be used. That is, the rights scope of the present disclosure is not limited to the method of selecting three speakers by using a mesh structure including triangles and may also include a method of selecting four or more speakers by using a mesh structure including polygons.

Distances between the first to third triangles L145, L345, and L235 included in the mesh structure and an object sound are calculated, and one of the first to third triangles L145, L345, and L235 is selected on the basis of the calculated distances. In the current embodiment, a triangle corresponding to the shortest distance is selected as an example. In addition, a multi-channel audio signal is generated by mapping the object sound to speakers located at vertices of the selected triangle, and the object sound is output by applying the generated multi-channel audio signal to the speakers.

A method of calculating distances between the first to third triangles L145, L345, and L235 and a location of an object sound will now be described in detail with reference to FIG. 5.

Figure 5:
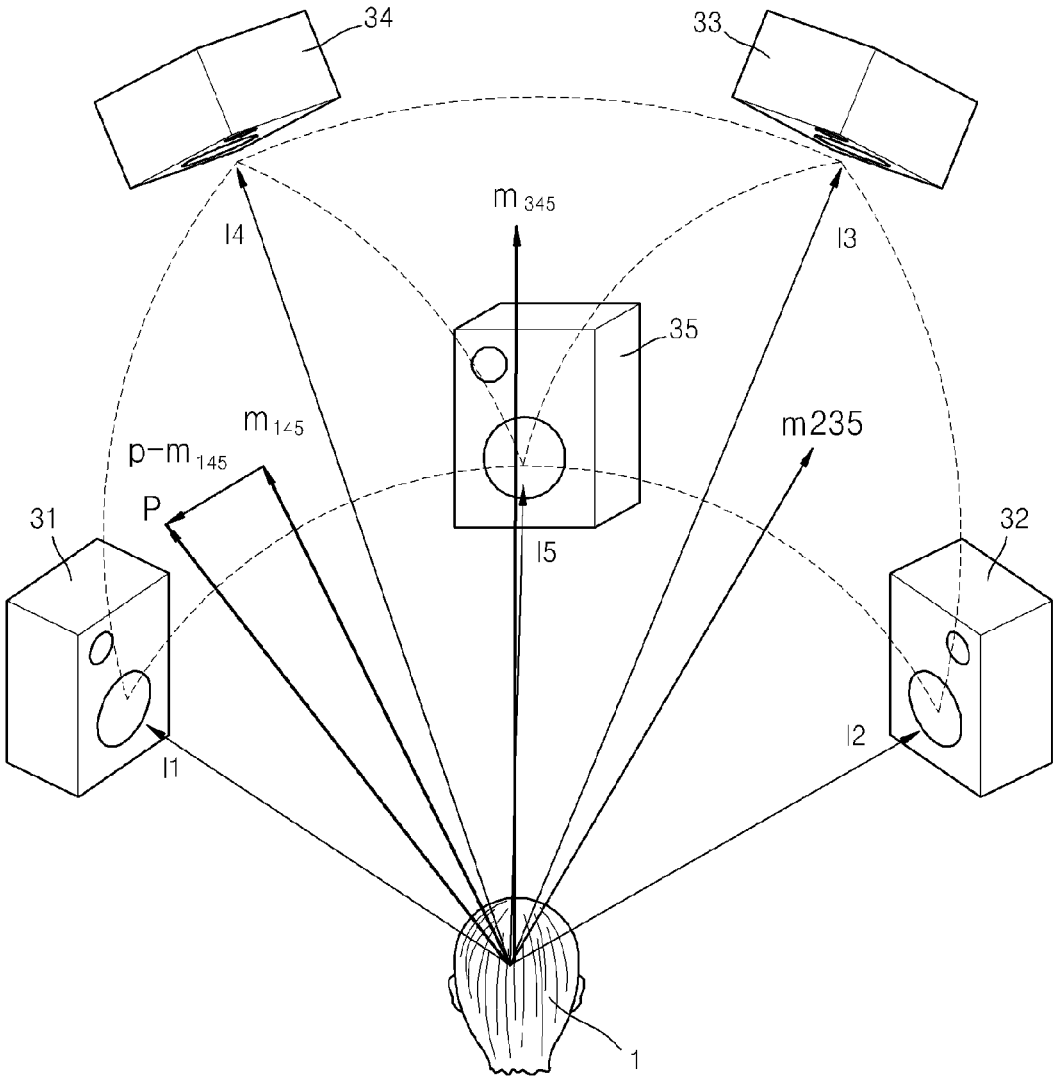
FIG. 5 illustrates an operation of calculating distances between a location of an object and triangles in a mesh structure representing a multi-channel speaker system, according to an embodiment of the present disclosure.

FIG. 5 illustrates an operation of calculating distances between a location of an object and the first to third triangles L145, L345, and L235 in a mesh structure representing a multi-channel speaker system, according to an embodiment of the present disclosure. Referring to FIG. 5, first, a reference point for distance calculation is set for each of the first to third triangles L145, L345, and L235. In this case, a random point on each of the first to third triangles L145, L345, and L235 may be set as the reference point. For example, the center of gravity of each of the first to third triangles L145, L345, and L235 may be set as the reference point.

In FIG. 5, the center points of gravity of the first to third triangles L145, L345, and L235 are respectively set as reference points. In this case, a location vector m145 of the center point of gravity of the first triangle L145 may be obtained using Equation 7. Likewise, location vectors m345 and m235 of the center points of gravity of the second and third triangles L345 and L235 may be obtained.

$$m_{145} = \frac{l_1 + l_4 + l_5}{3} \quad \text{Equation 7}$$

After setting the reference points of the first to third triangles L145, L345, and L235, distances between location vectors of the set reference points and an object sound are calculated. Referring to FIG. 5, a vector p-m145 is obtained by subtracting the location vector m145 of the center point of gravity of the first triangle L145 from a location vector p of the object sound. Likewise, vectors p−m345 and p−m235 may be obtained by subtracting location vectors m345 and m235 of the center points of gravity of the second and third triangles L345 and L235 from the location vector p of the object sound, respectively. A distance between the location vector m145 of the center point of gravity of the first triangle L145 and the location vector p of the object sound may be obtained using Equation 8.

$$|p - m_{145}| \quad \text{Equation 8:}$$

Likewise, distances between the location vectors m345 and m235 of the center points of gravity of the second and third triangles L345 and L235 and the location vector p of the object sound are calculated, and a polygon is selected on the basis of the calculated distances. In the current embodiment, a triangle corresponding to the shortest distance is selected as an example. In FIG. 5, since the location vector m145 of the center point of gravity of the first triangle L145 is the closest to the location vector p of the object sound, the first triangle L145 is selected. Therefore, a multi-channel audio signal is generated by mapping the object sound to the first speaker 31, the fourth speaker 34, and the fifth speaker 35 located at the vertices of the first triangle L145, and the generated multi-channel audio signal is applied to the first speaker 31, the fourth speaker 34, and the fifth speaker 35, thereby reproducing the object sound.

As described above, by representing a multi-channel speaker system as a mesh structure including a plurality of polygons whose vertices are located at corresponding speakers, calculating distances between the plurality of polygons forming the mesh structure and a location of an object sound, and selecting a polygon on the basis of the calculated distances, speakers corresponding to the location of the object sound may be quickly selected.

Although the 5-channel speaker system including five speakers has been described as an example with respect to FIGS. 3 to 5, the current embodiment may be applied to a multi-channel speaker system including more than five speakers.

Figure 6:
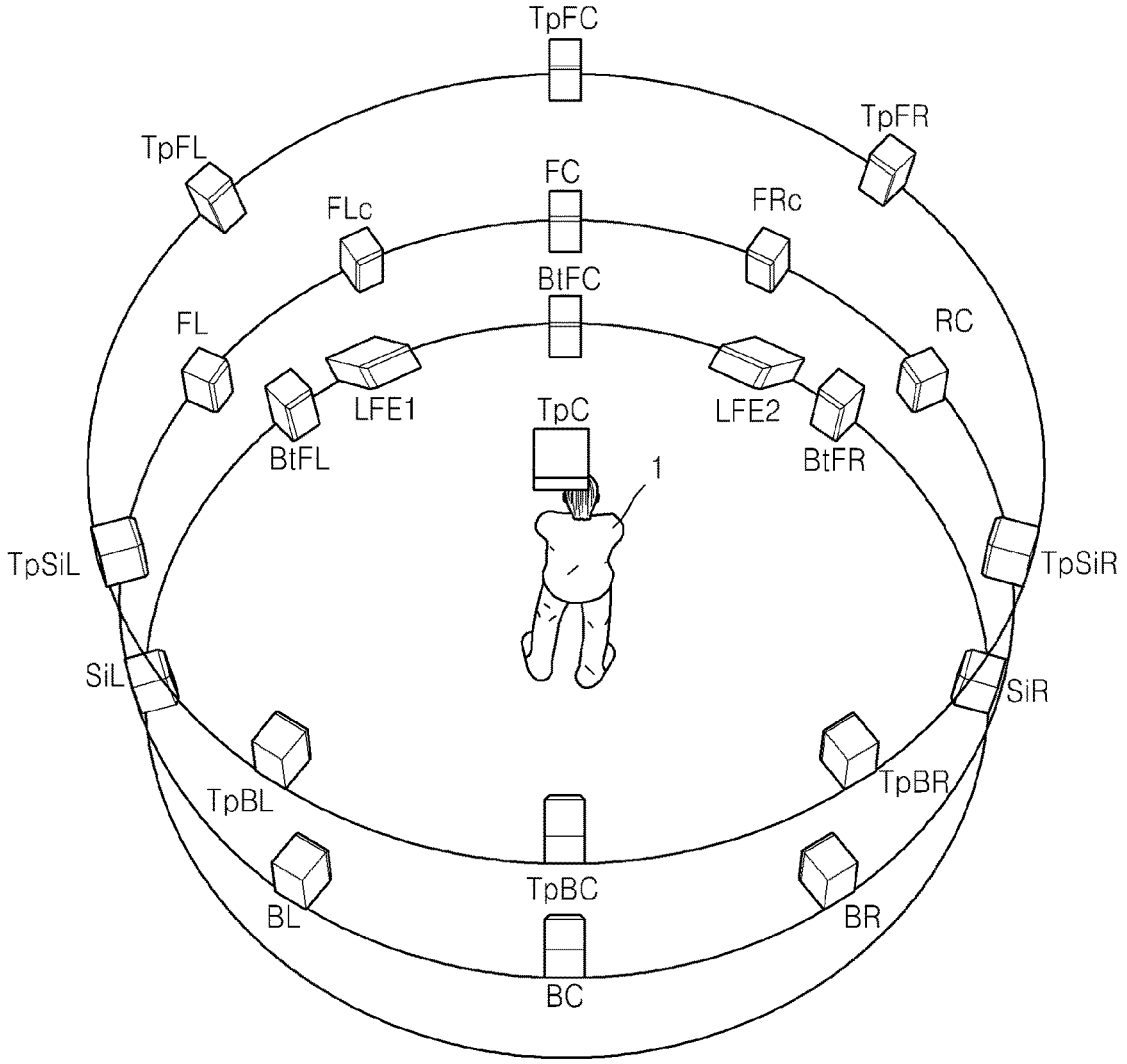
FIG. 6 illustrates a 22.2-channel speaker system proposed by Nippon Hoso Kyokai (NHK) and handled in the MPEG H 3D audio standard.

FIG. 6 illustrates a 22.2-channel speaker system proposed by Nippon Hoso Kyokai (NHK) and handled in the MPEG H 3D audio standard. Referring to FIG. 6, 24 speakers are arranged around a user 1. Abbreviations for the 24 speakers indicate locations of the 24 speakers based on the user 1. That is, Tp, F, Bt, C, R, L, Si, and B denote top, front, bottom, center, right, left, side, and back, respectively. For example, a speaker TpSiR is located at a top right side of the user 1. As described above, an approximate location of each speaker may be detected through an abbreviation attached to each speaker, and exact locations of the 24 speakers proposed in the standard are shown in the table of FIG. 7.

The 22.2-channel speaker system shown in FIG. 6 may be represented in a triangular mesh structure, wherein the table shown in FIG. 8 defines speakers located at vertices of each of 34 triangles forming the mesh structure. FIG. 8 is only an example of representing a triangular mesh structure, and the mesh structure may be represented by other methods.

A set of speakers to reproduce an object sound may be selected by representing the 22.2-channel speaker system shown in FIG. 6 as a triangular mesh structure according to the table shown in FIG. 8 and calculating and comparing distances between triangles and a location of the object sound. The description with respect to FIGS. 3 to 5 is referred to for a detailed method of setting reference points of the triangles and calculating distances between the reference points and a location of an object sound.

When the number of triangles included in a mesh structure is large since the number of speakers is also large as in the 22.2-channel speaker system, if distances from a location of an object sound with respect to all the triangles are calculated, an amount of computation may be large, thereby taking a long time for processing. Therefore, a method of reducing an amount of computation and improving a processing speed by calculating distances from a location of an object sound with respect to only some triangles will now be provided.

When speakers to reproduce a sound are selected for the first time with respect to a certain object, since information on a previous location of an object sound does not exist at all, it is recommended that distances from a location of the object sound with respect to all triangles be calculated. However, once speakers are selected for an object sound in a certain single frame, the possibility that a location of the object sound exists near a location in a previous frame is high even though a location of the object sound may move in a subsequent frame, and thus, distances from a location of the object sound may be calculated only with respect to triangles adjacent to previously selected triangles. That is, in an embodiment, distances from a location of the object sound may be calculated with respect to just triangles adjacent to previously selected triangles and not with respect to all triangles. A detailed description thereof will now be given with reference to FIG. 9.

Figure 9:
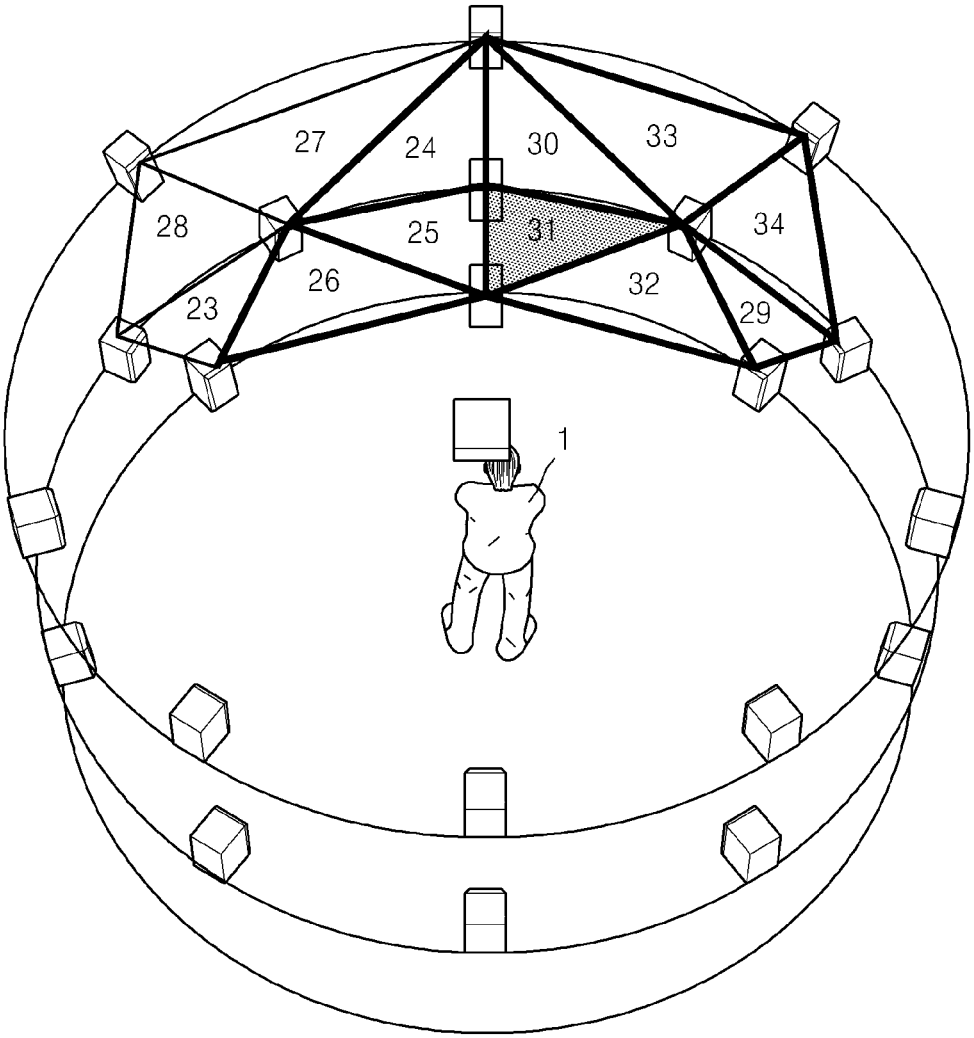
FIG. 9 illustrates some of triangles included in the triangular mesh structure representing the 22.2-channel speaker system of FIG. 6.

FIG. 9 illustrates some of triangles included in the triangular mesh structure representing the 22.2-channel speaker system of FIG. 6. Numbers marked on triangles match numbers for identifying triangles described in the table of FIG. 8. In FIG. 9, it is assumed that a triangle 31 is selected on the basis of a result of detecting a location of an object sound in a certain single frame and calculating distances between the location of the object sound and all triangles included in the mesh structure. When the triangle 31 is selected, an object sound is output using speakers BtFC, FRC, and FC located at the vertices of the triangle 31. Thereafter, if an object moves in a subsequent frame and the location of the object sound is changed, distances from the changed location of the object sound are calculated only with respect to triangles 24, 25, 26, 29, 30, 32, 33, and 34 adjacent to the triangle 31 instead of calculating distances from the changed location of the object sound with respect to all the triangles included in the mesh structure of the 22.2-channel speaker system.

In this case, a criterion for selecting adjacent triangles may be set in various ways. For example, triangles sharing at least one side or vertex with a triangle selected in a previous frame may be selected. In another example, triangles having the center point of gravity within a certain distance from the center point of gravity of a triangle selected in a previous frame may be selected. In still another example, triangles having at least one vertex within a certain distance from a vertex of a triangle selected in a previous frame may be selected.

As described above, by calculating distances from an object only with respect to triangles adjacent to a triangle selected in a previous frame when a location of an object sound moves, an amount of computation may be reduced, thereby improving a processing speed.

Figure 10:
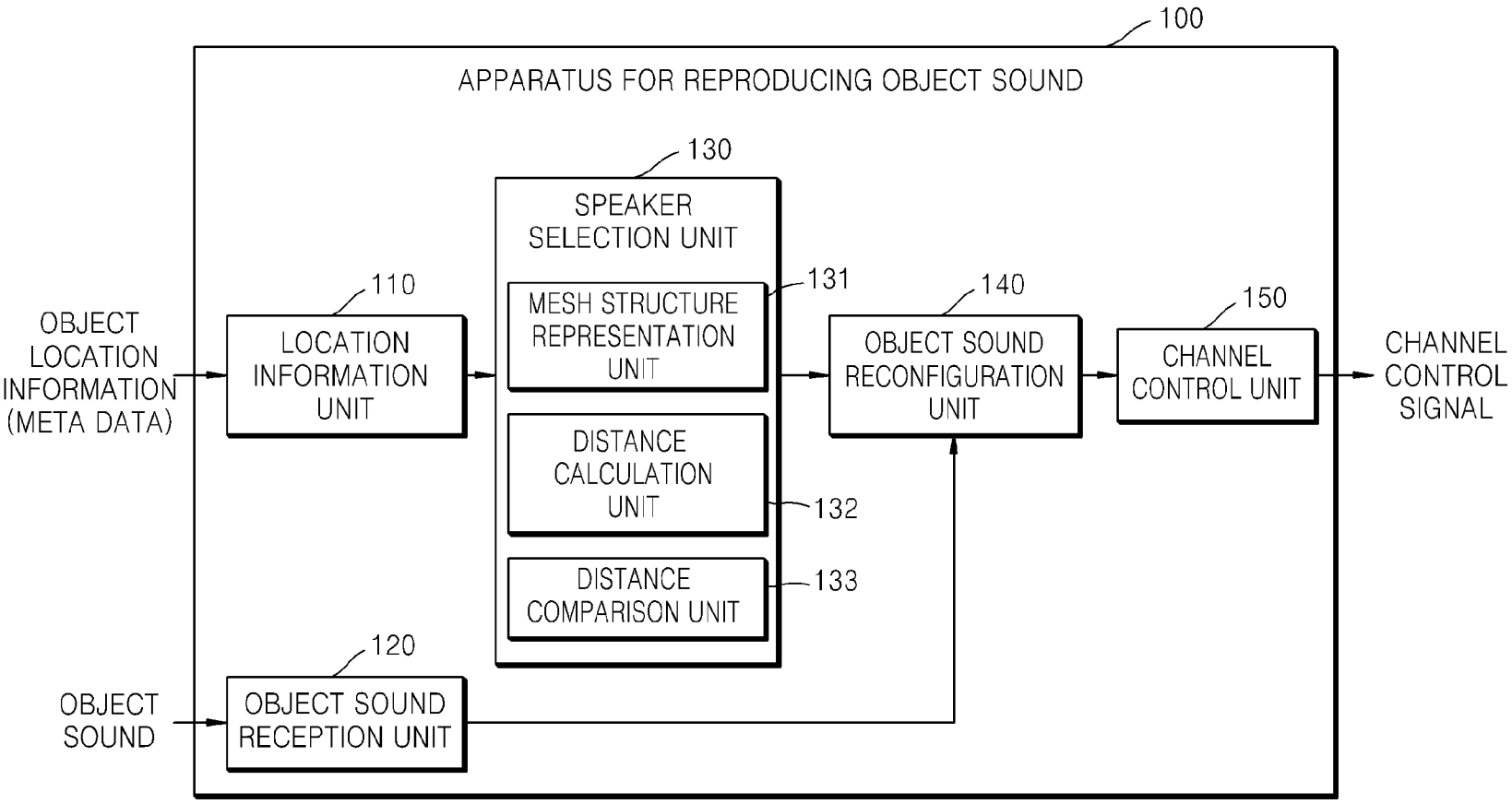
FIG. 10 is a block diagram of an apparatus for reproducing an object sound, according to an embodiment of the present disclosure.

FIG. 10 is a block diagram of an apparatus 100 for reproducing an object sound, according to an embodiment of the present disclosure. Referring to FIG. 10, the apparatus 100 according to an embodiment of the present disclosure may include, for example, a location information collection unit 110, an object sound reception unit 120, a speaker selection unit 130, an object sound reconfiguration unit 140, and a channel control unit 150, wherein the speaker selection unit 130 may include a mesh structure representation unit 131, a distance calculation unit 132, and a distance comparison unit 133.

The location information collection unit 110 collects location information of an object sound from metadata of an object and transmits the collected location information to the speaker selection unit 130. The object sound reception unit 120 receives an object sound and transmits the received object sound to the object sound reconfiguration unit 140.

The speaker selection unit 130 selects speakers to reproduce the object sound on the basis of the location information of the object sound. A detailed method of selecting speakers by applying a mesh structure is the same as described with reference to FIGS. 3 to 9. When the detailed method of selecting speakers is performed, the mesh structure representation unit 131 represents locations of a plurality of speakers included in a multi-channel speaker system as a mesh structure including a plurality of polygons whose vertices are located at locations of corresponding speakers. The distance calculation unit 132 calculates distances between the plurality of speakers forming the mesh structure and a location of the object sound. The distance comparison unit 133 selects a polygon on the basis of the distances calculated by the distance calculation unit 132, for example, selects a polygon corresponding to the shortest distance.

The object sound reconfiguration unit 140 performs a reconfiguration for reproducing the object sound through the selected speakers. For example, when the object sound is reproduced according to the VBAP method described above, the object sound reconfiguration unit 140 calculates gains corresponding to the selected speakers by using location vectors of the selected speakers and a location vector of the object sound and maps the object sound to the selected speakers by respectively applying the calculated gains to the selected speakers.

The channel control unit 150 generates control signals for reproducing the object sound in the multi-channel speaker system, i.e., a multi-channel audio signal, and outputs the control signals to the selected speakers of corresponding channels.

Figure 11:
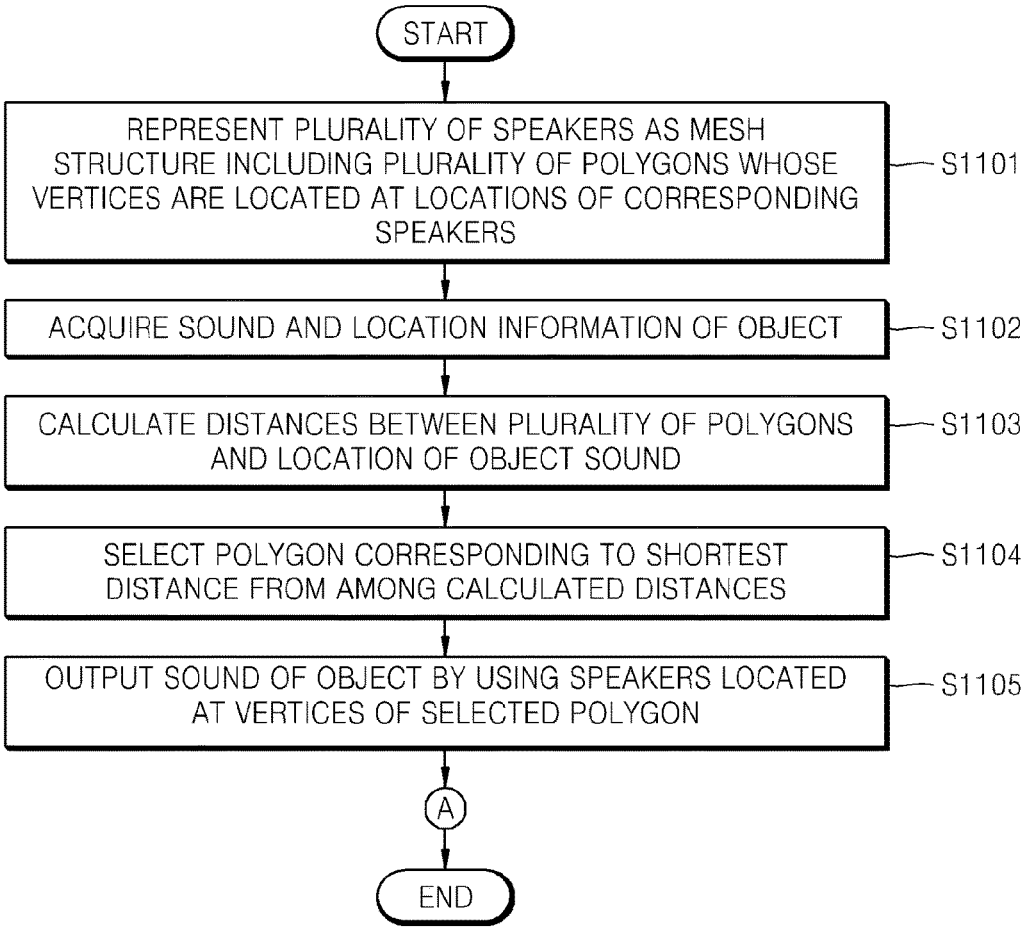
FIGS. 11 and 12 are flowcharts of a method of generating a multi-channel audio signal corresponding to a location of an object sound, according to an embodiment of the present disclosure.
Figure 12:
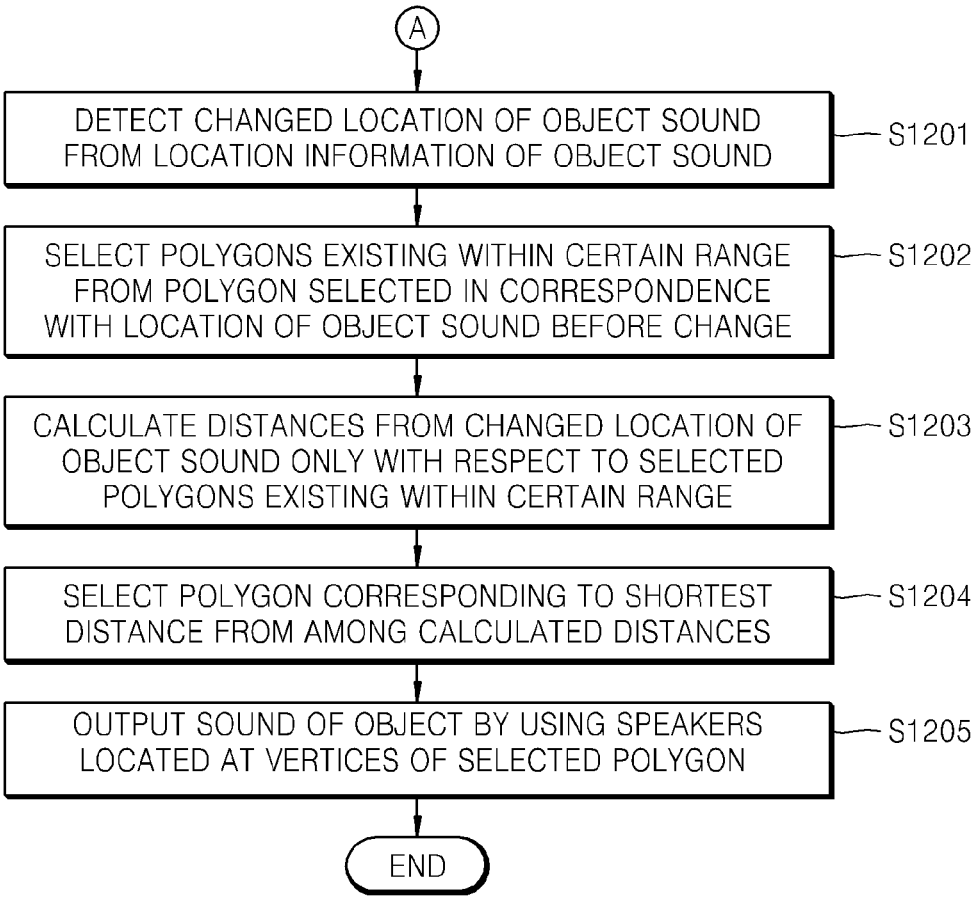

FIGS. 11 and 12 are flowcharts of a method of generating a multi-channel audio signal corresponding to a location of an object sound, according to an embodiment of the present disclosure.

Referring to FIG. 11, in operation S1101, a plurality of speakers included in a multi-channel speaker system are represented as a mesh structure including a plurality of polygons whose vertices are located at locations of corresponding speakers. In operation S1102, a sound and location information of an object are acquired, and in operation S1103, distances between each of the plurality of polygons and a location of an object sound are calculated. In operation S1104, a polygon is selected on the basis of the calculated distances. In the current embodiment, a polygon calculated as having the shortest distance to the location of an object sound is selected, as an example. In operation S1105, a multi-channel audio signal corresponding to speakers corresponding to the selected polygon is generated by mapping the object sound to the speakers corresponding to the selected polygon.

After selecting speakers with respect to an object sound in a certain single frame and generating a multi-channel audio signal according to the operations in FIG. 11, a multi-channel audio signal for a subsequent frame may be generated according to the operations in FIG. 12.

Referring to FIG. 12, in operation S1201, a changed location of an object sound is detected from location information of the object sound, for example using location information of the object sound from a previous frame. After detecting the changed location, polygons existing within a certain range from a polygon selected in correspondence with a location of the object sound before the change, i.e., a location of the object sound in the previous frame, are selected in operation S1202. In operation S1203, distances from the changed location of the object sound, i.e., the object sound in a subsequent frame, are calculated only with respect to the selected polygons existing within the certain range, and in operation S1204, a polygon is selected on the basis of the calculated distances. In the current embodiment, a polygon corresponding to the shortest distance is selected as an example. That is, in an embodiment, a polygon calculated as having the shortest distance to the location of an object sound is selected from among only the selected polygons existing within the certain range and without having to consider all of the polygons. In operation S1205, a multi-channel audio signal corresponding to speakers corresponding to the selected polygon is generated by mapping the object sound to the speakers corresponding to the selected polygon.

As described above, according to the one or more of the above embodiments of the present disclosure, by calculating distances between a location of an object sound and polygons whose vertices are located at locations of corresponding speakers in a multi-channel speaker system and selecting a polygon on the basis of the calculated distances, speakers to reproduce the object sound may be quickly selected.

In addition, when an object moves, by calculating distances from locations of the moved object only for polygons adjacent to the polygon selected before the object moves, an amount of computation may be reduced, and speakers may be more rapidly selected.

In addition, other embodiments of the present disclosure can also be implemented through computer-readable code/instructions in/on a medium, e.g., a computer-readable medium, to control at least one processing element to implement any of the above described embodiments. The medium can correspond to any medium/media permitting the storage and/or transmission of the computer-readable code.

The computer-readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as Internet transmission media. Thus, the medium may be such a defined and measurable structure including or carrying a signal or information, such as a device carrying a bitstream according to one or more embodiments of the present disclosure. The media may also be a distributed network, so that the computer-readable code is stored/transferred and executed in a distributed fashion. Furthermore, the processing element could include a processor or a computer processor, and processing elements may be distributed and/or included in a single device.

The described hardware devices may also be configured to act as one or more software modules in order to perform the operations of the above-described embodiments. The method of generating a multi-channel audio signal may be executed on a general purpose computer or processor or may be executed on a particular machine such as the multi-channel audio signal generating apparatus described herein. Any one or more of the software modules described herein may be executed by a dedicated processor unique to that unit or by a processor common to one or more of the modules.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present disclosure have been described with reference to the figures, it will be understood by those of ordinary skill in the art that various changes in form and details may be made therein without departing from the spirit and scope of the present disclosure as defined by the following claims.

What is claimed is:

1. A method of generating multi-channel control signals, the method comprising:

by a hardware-based processor:

representing locations of a plurality of speakers as a mesh structure including a plurality of polygons whose vertices are corresponding to the locations of the plurality of speakers;

acquiring a location of an object in a current video frame;

calculating a plurality of distances between the plurality of polygons included in the mesh structure, and the acquired location of the object, respectively;

selecting a polygon among the plurality of polygons included in the mesh structure based on the plurality of distances;

generating the multi-channel control signals corresponding to a plurality of speakers located in the selected polygon; and transmitting the multi-channel control signals to the plurality of speakers located in the selected polygon, to reproduce a sound corresponding to the object via the plurality of speakers located in the selected polygon, and wherein the selected polygon corresponds to a shortest distance among the plurality of distances.

2. The method of claim 1, wherein the calculating of the plurality of distances between the plurality of polygons included in the mesh structure and the location of the object comprises:

selecting a plurality of reference points corresponding to the plurality of polygons included in the mesh structure; and calculating the plurality of distances between the selected reference points and the location of the object.

3. The method of claim 2, wherein the selected reference points are center point of gravity of the plurality of polygons included in the mesh structure, respectively.

4. The method of claim 1, wherein the plurality of polygons included in the mesh structure are triangles, and the generating of multi-channel control signals comprises:

calculating gains for the plurality of speakers located in the selected polygon on basis of the location of the object; and mapping the sound corresponding to the object by applying the calculated gains to the plurality of speakers located in the selected polygon.

5. The method of claim 1, wherein the selected polygon is an adjacent polygon to a previous polygon selected in a previous video frame.

6. The method of claim 5, wherein the calculating of the plurality of distances between the plurality of polygons included in the mesh structure and the location of the object comprises:

selecting a plurality of polygons as adjacent polygons existing within a certain range of a previous polygon selected in the previous video frame; and calculating a plurality of distances from a changed location of the object with respect to the selected adjacent polygons existing within the certain range.

7. The method of claim 6, wherein the adjacent polygons existing within the certain range has a center point of gravity within a certain distance from a center point of gravity of the previous polygon selected in the previous video frame.

8. The method of claim 5, wherein the adjacent polygon shares at least one side or vertex with a previous polygon selected in the previous video frame.

9. A non-transitory computer-readable storage medium having stored therein program instructions, which when executed by a computer, perform the method of claim 1.

10. An apparatus for generating multi-channel control signals, the apparatus comprising:

a hardware-based processor to:

represent locations of a plurality of speakers as a mesh structure including a plurality of polygons whose vertices are corresponding to the locations of the plurality of speakers;

acquire a location of an object in a current video frame;

receive a sound corresponding to the object;

calculate a plurality of distances between the acquired location of the object and the plurality of polygons included in the mesh structure, respectively;

select a polygon among the plurality of polygons included in the mesh structure based on the plurality of distances; and generate the multi-channel control signals corresponding to a plurality of speakers located in the selected polygon, to thereby reproduce the sound corresponding to the object in the current video frame via the plurality of speakers located in the selected polygon.

11. The apparatus of claim 10, wherein the correspondence of the vertices of the plurality of polygons to the plurality of speakers are represented by the mesh structure.

12. The apparatus of claim 11, wherein when a location of the object is changed in the current video frame after multi-channel audio signals are generated with respect to a previous video frame, the selected polygon is an adjacent polygon to a previous polygon selected in a previous video frame.

13. The apparatus of claim 12, wherein the hardware-based processor is further configured to:

select a plurality of polygons as adjacent polygons existing within a certain range of the previous polygon selected in the previous video frame;

calculate a plurality of distances from a changed location of the object with respect to the selected adjacent polygons existing within the certain range;

select a polygon among the selected adjacent polygons existing within the certain range based on the plurality of distances from a changed location of the object with respect to the selected adjacent polygons existing within the certain range; and generate multi-channel control signals that corresponds to a plurality of speakers located in the selected polygon among the selected adjacent polygons.

14. The apparatus of claim 13, wherein the selected adjacent polygons shares at least one side or vertex with the previous polygon selected in the previous video frame.

15. The apparatus of claim 10, wherein to calculate the plurality of distances, a plurality of reference points corresponding to the plurality of polygons included in the mesh structure are selected and the plurality of distances between the selected reference points and the location of the object are calculated.

16. The apparatus of claim 15, wherein the selected reference points are center points of gravity of the plurality of polygons included in the mesh structure, respectively.

17. The apparatus of claim 10, wherein the plurality of polygons included in the mesh structure are triangles, and to generate the multi-channel control signals, gains for the plurality of speakers located in the selected polygon on basis of the location of the object is calculated and the sound is mapped by applying the calculated gains to the plurality of corresponding speakers located in the selected polygon.

18. A method of generating multi-channel control signals by representing a plurality of speakers included in a multi-channel speaker system as a mesh structure including a plurality of polygons which vertices are corresponding to locations of each of the plurality of speakers, the method comprising:

by a hardware-based processor:

acquiring a location of an object in a current video frame using location information of the object from a previous video frame;

selecting a plurality of polygons existing within a certain distance of a polygon selected with the location information of the object from the previous video frame;

calculating a plurality of distances between each of the selected polygons existing within the certain distance and the location of the object in the current video frame;

selecting a final polygon, from among the selected polygons existing within the certain distance, which is closest to the location of the object based on the calculated distances;

generating the multi-channel control signals by mapping a sound corresponding to the object to a plurality of speakers, among the plurality of speakers included in the mesh structure, corresponding to the final polygon; and transmitting the multi-channel control signals to the plurality of speaker located in the final polygon, to thereby reproduce the sound in the current video frame via the plurality of speakers located in the final polygon.

19. The method of claim 18, wherein the final polygon is selected by calculating a plurality of distances between a center point of gravity of each of the selected polygons and the acquired location of the object.

* * * * *